US005961286A

United States Patent [19]

Schaub et al.

[11] Patent Number: 5,961,286

[45] Date of Patent: Oct. 5, 1999

[54] ARRANGEMENT WHICH CONSISTS OF A NUMBER OF FIXING SLOTS AND IS INTENDED FOR FITTING A ROTOR OR A STATOR OF A FLUID-FLOW MACHINE WITH BLADES

[75] Inventors: Fritz Schaub, Villnachern; Hans Wettstein, Fislisbach, both of Switzerland

[73] Assignee: Asea Brown Boveri AG, Baden, Switzerland

[21] Appl. No.: 08/999,237

[22] Filed: Dec. 29, 1997

[30] Foreign Application Priority Data

Dec. 27, 1996 [DE] Germany ..... 196 54 471

[51] Int. Cl.[6] ..... F01D 5/30

[52] U.S. Cl. ..... 415/209.3; 415/209.1; 415/198 R; 416/215; 416/219 R

[58] Field of Search ..... 416/215, 219 R, 416/198 R, 200 R; 415/209.1, 209.2, 209.3

[56] References Cited

U.S. PATENT DOCUMENTS

| | | | |
|---|---|---|---|
| 2,619,318 | 11/1952 | Schaer | 416/219 R |
| 3,801,220 | 4/1974 | Beckershoff | 416/198 |
| 4,427,343 | 1/1984 | Fosdick | 416/200 A |
| 4,483,054 | 11/1984 | Ledwith | 416/198 A |
| 5,147,180 | 9/1992 | Johnson | 416/219 R |
| 5,257,909 | 11/1993 | Glynn et al. | 416/220 R |
| 5,308,227 | 5/1994 | Gros et al. | 416/219 R |
| 5,520,514 | 5/1996 | Mareix et al. . | |
| 5,584,658 | 12/1996 | Stenneler | 416/215 |

FOREIGN PATENT DOCUMENTS 838 191 5/1952 Germany .

OTHER PUBLICATIONS

Beneke, W., Oberdieck, K., "Festigkeitsuntersuchungen an Reiterfussen fur Axialverdichterschaufeln," 1965.

*Primary Examiner*—F. Daniel Lopez
*Assistant Examiner*—Ninh Nguyen
*Attorney, Agent, or Firm*—Oblon, Spivak, McClelland, Maier & Neustadt, P.C.

[57] ABSTRACT

In an arrangement for fixing blades (5) to a rotor (1) or stator, a number of slots (7) which run helically on the circumferential surface of the body to be fitted with blades are provided, filling pieces (6) which serve to space apart the blades (5) and fix the blades (5) in a frictional manner being present between individual blade rows (3).

7 Claims, 2 Drawing Sheets

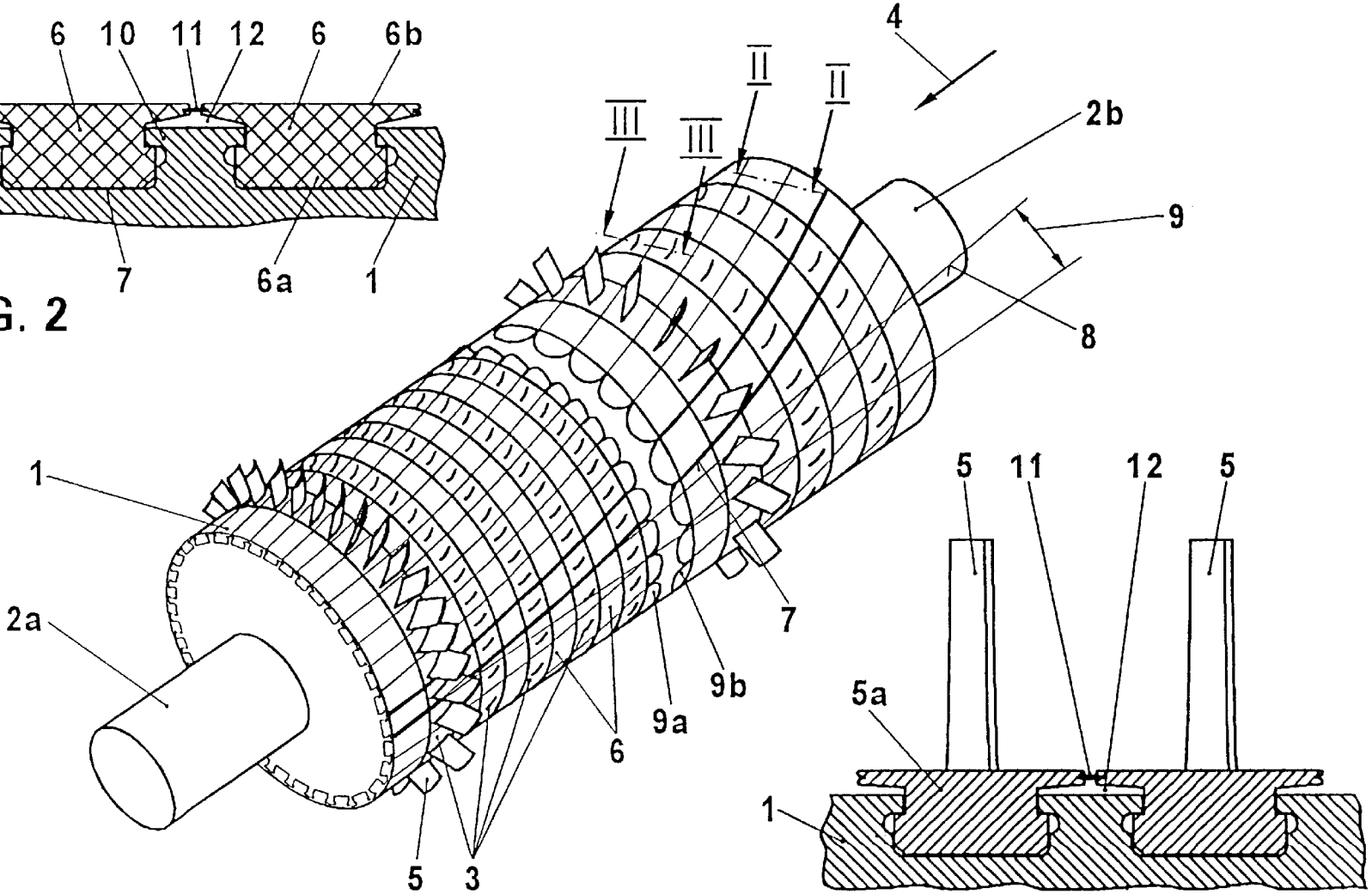
FIG. 1
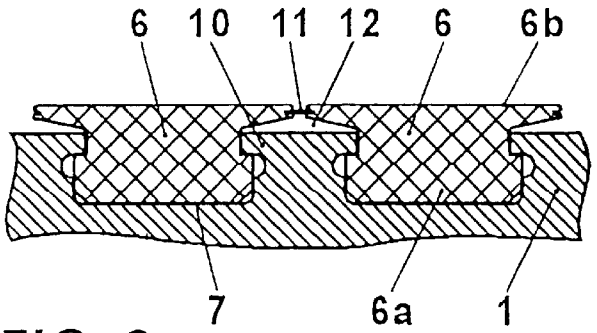
FIG. 2
FIG. 3

ARRANGEMENT WHICH CONSISTS OF A NUMBER OF FIXING SLOTS AND IS INTENDED FOR FITTING A ROTOR OR A STATOR OF A FLUID-FLOW MACHINE WITH BLADES

BACKGROUND OF THE INVENTION

1. Field of the Invention

The present invention relates to an arrangement according to the preamble of claim 1.

2. Discussion of Background

Blading systems of fluid-flow machines normally have profiles which, in the rotor and stator region, have skeleton lines deviating greatly from the axial direction. Often, however, angles relative to the axial direction are kept in the same order of magnitude over the entire blading or over restricted regions of the blading. In order to minimize an increase in stress in the fastening, fixing slots are therefore milled at an angle, a factor which, in the case of rotors, on account of the milling-tool motions associated therewith, inevitably results in constructions having cover plates, rings, or parts attached to the rotor on the hub side of the guide-blade rows. These slots have hitherto only been made individually for each blade row. Such solutions are inherently expensive on account of the many machining surfaces and edges.

In the case of conventional guide-blade attachments in peripheral slots of stators, solutions which are unfavorable in terms of strength are often necessary, in particular if heat shields are also to be fixed between the guide-blade rows.

In contrast, cost-effective solutions per se, in which the fixing slots are milled so as to be axially continuous, have been disclosed. However, these have the disadvantage that they result in a stress-increasing twist of the main profile axis in the fixing region.

SUMMARY OF THE INVENTION

Accordingly, one object of the invention, as defined in the claims, is to remove the said disadvantages in an arrangement of the type mentioned at the beginning by means of a simple design.

For this purpose, the body to be fitted with blades, which may be the rotor or stator of a fluid-flow machine, is provided with slots which run helically along the circumferential surface, to be fitted with blades, of the corresponding body. The rotor or the stator of the fluid-flow machine then has, as it were, a multi-start thread with a large pitch, irrespective of whether the entire length of the body or sections thereof are fitted with blades. Filling pieces, which correspond to the inserted blades, but without blade body, are inserted in rows between the blade rows.

The essential advantages of the invention can be seen in the fact that the blades, which are inserted in a helical geometrical configuration, exhibit optimum static and dynamic strength, in particular at the transitions between blade root and blade body, in which case the slot per se may have any one of many different cross sections. This slot is preferably designed in a fir-tree, dovetail or hammer shape.

According to the invention, it is also possible to achieve partial or complete thermal insulation of the body by passages being formed in the region of the adjoining blades and/or filling pieces, in which case cooling air or cooling steam can flow here through these passages. It is easily possible to pass this cooling medium through laterally into the interior of the blades.

The machining of the slot can be achieved without the need for many tools; in most cases this will be done with a single milling tool. The milling of the slot along the circumferential surface of the respective body is preferably effected with a rotating form cutter, which is guided along the circumferential surface on a certain inclined plane relative to the cylinder axis.

If the negative properties of natural vibration resonances of the body in the case of an even number of slots can be eliminated by auxiliary measures, the machining of the slots can be achieved on a milling machine by the use of two form cutters which are located opposite one another and, in one operation, simultaneously machine one slot each lengthwise in the body to be fitted with blades.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a blading of a rotor of a fluid-flow machine, in which the slots for accommodating the blades are milled helically in the circumferential surface, two groups of blade rows having different pitch being shown, FIG. 2 shows a fixing arrangement of the filling pieces in a hammer-profile shape, FIG. 3 shows a fixing arrangement of the blade roots in a hammer-profile shape.

DESCRIPTION OF THE PREFERRED EMBODIMENTS

Figure 6:
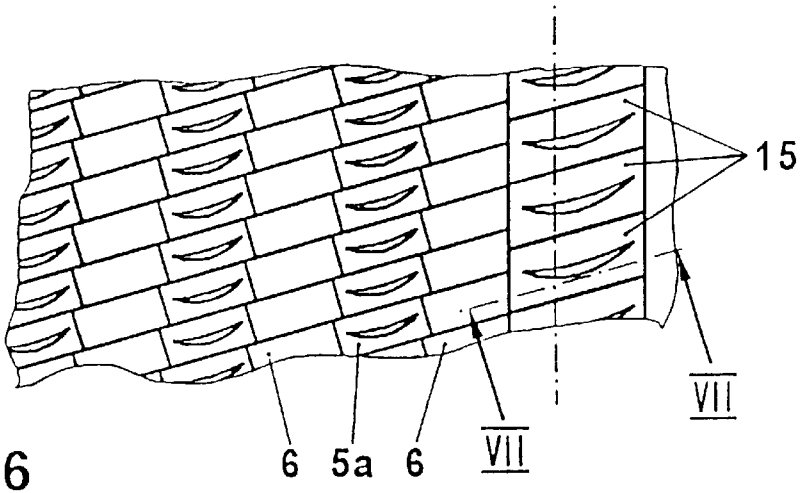
FIG. 6 shows interfaces between blade root and filling piece as well as an end of the helical-slot indentation zone at a blade row in a peripheral-slot fixing arrangement.

Referring now to the drawings, wherein like reference numerals designate identical or corresponding parts throughout the several views, all elements not required for directly understanding the invention have been omitted, and the direction of flow of the media is indicated by arrows, FIG. 1 shows a rotor 1 of a compressor of a gas turbine. For the sake of completeness, the end hubs 2*a*, 2*b* of this rotor 1 are also shown here, at least the hub 2*a* serving as a supporting body. The circumferential surface of this rotor 1 is fitted with a number of moving-blade rows 3, which produce the compression of drawn-in air 4. The direction of flow is strictly predetermined here in this compressor in so far as at least the blade-body height decreases in the direction of flow, as shown in connection with FIG. 3. Two blade rows of the rotor 1 are shown in an integral manner here and these clearly indicate this compression. At the remaining blade rows, only an indication of the blades 5 is shown. Filling pieces 6, which serve to space apart the rows and axially lock the system in a frictional manner, are likewise arranged in rows between the individual blade rows 3. The root-side configuration of these filling pieces 6 corresponds to that of the blades 5, as can be seen from FIGS. 2 and 3. For machining reasons, the rotor is split into two zones, which, in accordance with the requirements, accommodate two groups of blade rows having different pitch and therefore a different number of blades. However, all the blades in the combination form a unit, the action of which depends on the type of blading. Of course, the different pitch is not restricted to the configuration shown. The run of the slot 7 for accommodating the blades 5 or filling pieces 6 describes a helix form in axial direction on the circumferential surface of the rotor, which helix form is formed from an inclined plane 8 having a certain angle of inclination 9. If the circumferential surface of the rotor 1 is completely machined in the peripheral direction with such helically disposed slots 7, the rotor 1 has, as it were, a multi-start thread. The blades 5 and the filling pieces 6 can easily be pushed into position along the inclined plane, since the rotor 1 is provided with slots 7 from both ends, which slots 7 in each case extend approximately up to the center of the rotor 1. Recesses 9*a*, 9*b*, which serve the machining of the slots 7 as a runout zone for the form-cutting tool, are provided at the slot ends, where the transition to the blades of different pitch is provided. Given such a machining possibility, the sectorial helices, as far as the angle of inclination and the width of the slot is concerned, may be individually designed according to requirements.

Owing to the fact that the fixing arrangement of the blades 5 is arranged along a helix on the circumferential surface of the rotor 1, optimum static and dynamic strength values are achieved at the transitions between blade root and blade body with regard to the impulse forces caused by the flow of the medium, whereby the service life of the blades 5 is markedly increased and fatigue fractures are ruled out. These considerations also apply to turbine rotors or stators designed in such a way.

FIG. 2 is a view along the section plane II—II in FIG. 1 and shows the geometry of the filling pieces 6 in the installed state in the rotor 1. The root part 6*a* of these filling pieces 6 has a hammer shape, which is easy to produce, and the filling pieces 6 are easily pushed into position. Other geometrical forms are of course also possible here, for example a multi-serrated fir-tree profile, a dovetail-profile form, etc. Which geometrical form is ultimately put into effect depends on the type of blades used and on the design criteria of the corresponding fluid-flow machine. The top side 6*b* of the filling pieces 6 has a widened portion on both sides relative to the width of the slot 7 running helically on the circumferential surface of the rotor 1, which widened portion serves to overlap the intermediate web 10 of the adjacent slots 7. The adjacent flanks of these overlaps are closed off in the axial direction by sealing strips 11 in such a way that an intermediate passage 12, through which a cooling medium can flow, is produced underneath in interaction with the circumferential surface of the rotor 1.

FIG. 3 is a view along the section plane III—III in FIG. 1 and shows the geometry of the blades 5, the height of which is only to be understood qualitatively. As far as the design and function are concerned, the blade root 5*a*, the sealing strips 11 and the intermediate passage 12 correspond to the configuration in the surrounding zone of the filling pieces according to FIG. 2.

Figure 4:
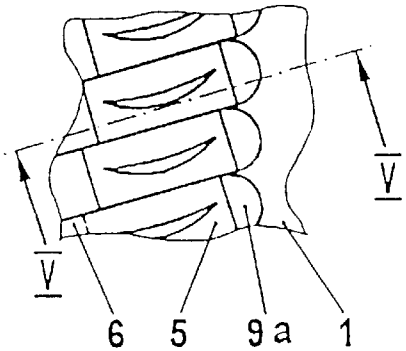
FIG. 4 shows a milled slot runout in the solid body.

FIG. 4 shows the end recess 9*a* of a slot and the blades 5 pushed in there, which form the blade row of the rotor 1 which is pushed in first. An intermediate row of filling pieces 6 can partly be seen in this figure. The stop for the individual blades 5 in the region of the recesses 9*a* is preferably effected by an end piece (not shown in any more detail here), so that a clear axial reference surface for the pushed-in blades 5 is predetermined. In interaction with the filling pieces 6, this also provides for satisfactory locking of the blades 5 which are pushed in there, this locking preferably being based on a frictional connection.

Figure 5:
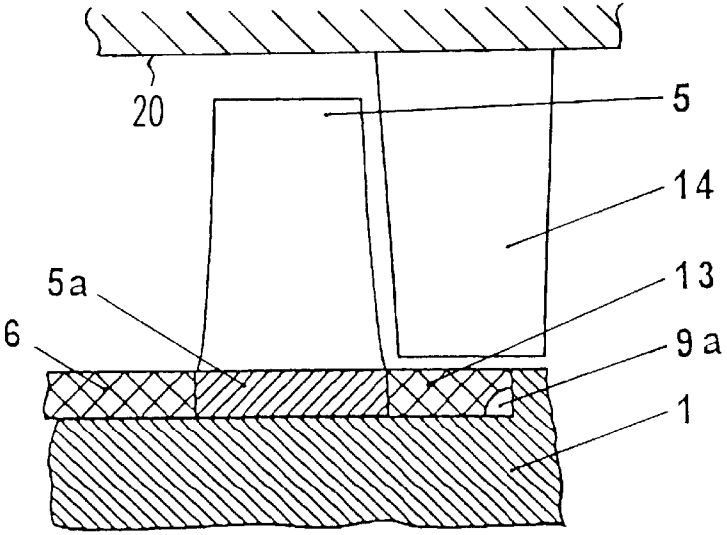
FIG. 5 shows a sectional view of the configuration according to FIG. 4.

FIG. 5 is a view along section plane V—V in FIG. 4 and it shows, in addition to the known configuration of the blade 5, the blade root 5*a* and the filling piece 6, which adjoin one another here in the plane along the helix, the end piece 13, already mentioned with reference to FIG. 4, in the recess 9*a*. A guide blade 14, which is intended to show the nature of the blading of the stator 20, is also shown here. The same configuration concerning the end piece also applies to the other recess 9*b* according to FIG. 1.

FIG. 6 shows the effective configuration of the interfaces between the blade roots 5*a* and the filling pieces 6, which are approximately at right angles to the slot run. Furthermore, this figure shows a combination between the slot run described with reference to FIG. 1, together with the formation of the blade rows with intermediate arrangement of the filling pieces 6, and an end blade row, the blades 15 of which are fixed in a peripheral slot and have a different pitch. As will be explained in more detail with reference to FIG. 7, the milled-out portion for the blade root at this peripheral slot can serve as a respective machining-related end recess for the helically running slot on the circumferential surface of the rotor.

Figure 7:
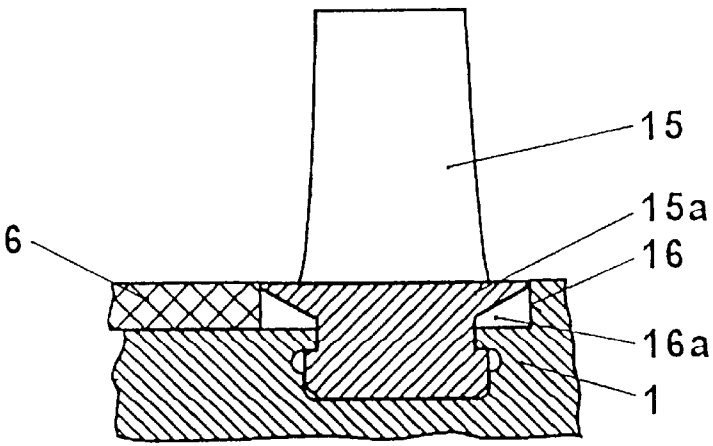
FIG. 7 shows a sectional view of FIG. 6.

FIG. 7 shows the end moving-blade row, the blades 15 of which are arranged in a conventional manner in a peripheral slot 16 and are fixed there. The blade root 15*a* of such a moving blade 15 largely corresponds to that of the other blades (cf. FIG. 3). The recess 16*a* at this peripheral slot 16 serves as a machining-related end recess for producing the helically running slot.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An arrangement for the fixation of blades and/or vanes of a fluid-flow machine, comprising:

a number of fixing slots, wherein said fixing slots run helically on a circumferential essentially-convex or concave cylinder-shaped surface, and in which fixing slots, the blades and/or vanes are mounted by insertion of blade and/or vane roots;

filling pieces which are inserted in the fixing slots between each blade and/or vane row; and at least one cooling air path, formed by integral intermediate passages or cavities, through which integral intermediate passages or cavities a cooling medium can flow, said integral intermediate passages and or cavities formed by sealing strips and adjoining filling pieces and blade and/or vane roots, said sealing strips connecting said adjoining filling pieces and roots;

wherein the fixing slots are divided into at least two zones in a longitudinal direction of the surface, and a circumferential distance and/or pitch of the helix are different for each zone.

2. The arrangement as claimed in claim 1, wherein the cross sections of the fixing slots have a fir-tree, dovetail or hammer shape.

3. The arrangement as claimed in claim 1, wherein there are intermediate recesses in the rotor and/or the stator, which recesses in each case form the end run of each fixing slot.

4. An arrangement for the fixation of blades and/or vanes of a fluid-flow machine, comprising:

a plurality of fixing slots, extending helically on a circumferential cylinder-shaped surface of a fluid-flow machine;

a plurality of at least one of blades and vanes mounted into said plurality of fixing slots forming a plurality of rows;

a plurality of filling pieces mounted in the fixing slots between each of the rows;

at least one sealing strip connecting at least one of blades, vanes and filling pieces mounted in adjacent fixing slots, said at least one sealing strip configured to form a cooling air path between said circumferential cylinder-shaped surface and said at least one of blades, vanes and filling pieces;

wherein the circumferential surface is divided into at least two circumferentially extending zones, wherein a pitch of the helically extending fixing slots are different for each of the at least two zones.

5. The arrangement according to claim 4, wherein said filling pieces and said plurality of at least one of blades and vanes comprise root portions mounted in said plurality of fixing slots, wherein said at least one sealing strip is connected to the root portions.

6. The arrangement as claimed in claim 4, wherein the cross sections of the fixing slots have a fir-tree, dovetail or hammer shape.

7. The arrangement as claimed in claim 4, wherein there are intermediate recesses in the cylindrical surface, which recesses in each case form the end run of each fixing slot.

* * * * *